US010743700B1

(12) United States Patent
Sayed et al.

(10) Patent No.: US 10,743,700 B1
(45) Date of Patent: Aug. 18, 2020

(54) CURTAIN ROD WALL MOUNT

(71) Applicant: KING SAUD UNIVERSITY, Riyadh (SA)

(72) Inventors: Hany Hassan Aly Sayed, Riyadh (SA); Thamer Ali Albahkali, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/745,305

(22) Filed: Jan. 16, 2020

(51) Int. Cl.
*A47H 1/102* (2006.01)
*A47H 1/142* (2006.01)

(52) U.S. Cl.
CPC ..... *A47H 1/142* (2013.01); *A47H 1/102* (2013.01)

(58) Field of Classification Search
CPC . A47H 1/00; A47H 1/02; A47H 1/022; A47H 1/10; A47H 1/102; A47H 1/12; A47H 1/13; A47H 1/122; A47H 1/142; A47H 1/14; A47H 2001/0215
USPC ..... 211/180, 105.1–105.6, 123; 248/261, 248/264, 265, 268, 257, 256, 269; 160/330, 368.1, 333
See application file for complete search history.

(56) References Cited

U.S. PATENT DOCUMENTS 1,205,552 A * 11/1916 Nelson ..... A47H 1/13 248/253
1,891,588 A * 12/1932 Frank ..... A47L 3/00 410/151
1,951,660 A * 3/1934 Klaudt ..... A47H 1/022 211/123
2,032,842 A * 3/1936 Gould ..... A47H 1/022 211/105.6
2,199,851 A 5/1940 Culver
2,964,276 A * 12/1960 Silverthorne ..... A47H 1/102 248/201
2,973,870 A 3/1961 Schoos
2,974,805 A * 3/1961 Brossean ..... A47H 1/022 211/105.5
2,974,806 A * 3/1961 Seewack ..... A47H 1/102 211/123
3,040,902 A * 6/1962 Dunn ..... A47B 61/003 211/105.4

(Continued)

FOREIGN PATENT DOCUMENTS

DE 19950950 A1 11/2001
EP 962175 A1 12/1999
GB 867714 A 5/1961

*Primary Examiner* — Johnnie A. Shablack
(74) *Attorney, Agent, or Firm* — Richard C. Litman; Nath, Goldberg & Meyer

(57) ABSTRACT

The curtain rod wall mount is a fixture used in pairs to support opposing ends of a cylindrical curtain rod between opposing walls of a building or window frame. In a first embodiment, the wall mount includes a helical spring disposed between a fixed plug and a movable plug, the spring being coaxially disposed around a guide screw extending between the plugs, the spring assembly being housed in a tubular sleeve that an end of the curtain rod slides into to bear against the movable plug. A second embodiment is similar to the first, but omits the guide screw. In a third embodiment, the wall mount has a wall plate having a threaded stud extending therefrom. The tubular sleeve has a plug with an internally threaded bore in one end that engages the threaded stub, the other end being hollow to receive an end of the curtain rod.

9 Claims, 3 Drawing Sheets

(56) References Cited

U.S. PATENT DOCUMENTS 3,333,808 A * 8/1967 Du Boff ..... E04G 25/04 248/200.1
3,521,758 A * 7/1970 Guilfoyle, Sr. .... A47G 25/0692 211/105.4
3,572,511 A * 3/1971 Triplett ..... A47H 1/102 211/105.6
3,633,862 A * 1/1972 Breen ..... A47H 1/102 248/251
3,687,499 A * 8/1972 Guilfoyle, Sr. .... A47G 25/0692 403/292
3,880,394 A * 4/1975 Wisecarver ..... E04G 25/06 248/354.3
4,248,418 A * 2/1981 Friedberg ..... A63B 9/00 211/105.5
4,737,056 A * 4/1988 Hunt ..... B60P 7/15 224/404
4,809,401 A * 3/1989 Honig ..... A47H 1/022 16/87.2
4,848,432 A * 7/1989 Connolly ..... E06B 9/174 160/178.1 R
4,895,471 A * 1/1990 Geltz ..... F16B 7/14 211/105.3
5,330,061 A * 7/1994 Geltz ..... A47K 3/38 211/105.4
6,571,426 B2 * 6/2003 Chen ..... A47B 61/003 16/87 R
6,694,543 B2 * 2/2004 Moore ..... A47H 1/022 248/261
6,845,955 B1 * 1/2005 Hsu ..... A47K 3/38 211/123
7,877,824 B2 * 2/2011 Grant ..... A47K 3/38 4/576.1
7,997,428 B2 * 8/2011 Goldstein ..... A47H 1/022 16/87 R
8,215,501 B2 * 7/2012 Trettin ..... A47K 3/38 211/105.2
8,479,932 B2 * 7/2013 Carney ..... A47H 1/022 211/105.5
8,505,129 B2 * 8/2013 Parker ..... A47H 1/022 211/105.1
8,505,749 B2 * 8/2013 Trettin ..... A47K 3/38 211/105.2
8,925,747 B1 * 1/2015 Hanley ..... A47H 1/022 211/105.6
9,009,878 B2 * 4/2015 Baines ..... A47K 3/38 4/558
9,021,627 B2 * 5/2015 Parker ..... A47K 3/38 211/105.4
9,474,421 B2 * 10/2016 Baines ..... A47K 3/38
10,047,787 B2 * 8/2018 Cheng ..... F16B 7/1463
10,426,287 B1 * 10/2019 Tsai ..... A47H 1/022
10,478,019 B2 * 11/2019 Pegden ..... A47H 1/022
2002/0148796 A1 * 10/2002 Lin ..... A47B 61/003 211/123
2003/0217410 A1 * 11/2003 Moore ..... A47H 1/022 4/610
2006/0130983 A1 * 6/2006 Nien ..... A47H 1/02 160/330
2008/0295240 A1 * 12/2008 Chang ..... A47K 3/38 4/610
2009/0101609 A1 * 4/2009 Batshon ..... A47H 1/022 211/105.3
2009/0223917 A1 * 9/2009 Grant ..... A47K 3/38 211/105.4
2011/0297632 A1 * 12/2011 Goldstein ..... A47H 1/022 211/105.6
2012/0005823 A1 * 1/2012 Baines ..... A47K 3/38 4/610
2012/0152874 A1 * 6/2012 Didehvar ..... A47K 3/38 211/105.4
2012/0193042 A1 * 8/2012 Koop ..... E06B 9/50 160/323.1
2014/0084122 A1 * 3/2014 Shevick ..... E06B 9/50 248/268
2014/0374367 A1 * 12/2014 Morel ..... A47H 1/022 211/105.3
2015/0196168 A1 * 7/2015 Baines ..... A47K 3/38 4/610
2015/0342385 A1 * 12/2015 Simbruner ..... A47H 1/102 248/231.21
2016/0073813 A1 * 3/2016 Cheng ..... A47H 1/142 248/262
2016/0206126 A1 * 7/2016 Ford ..... A47H 1/022
2017/0079458 A1 * 3/2017 Engell ..... A47H 1/022
2018/0098656 A1 * 4/2018 Baines ..... A47H 1/14

* cited by examiner

CURTAIN ROD WALL MOUNT

BACKGROUND

1. Field

The disclosure of the present patent application relates to curtain rods, and particularly to various embodiments of a curtain rod wall mount that allow for adjustment of the rod without the use of tools.

2. Description of the Related Art

Curtain rods, whether for shower curtains, window curtains, or other curtains or articles that are hung between opposing walls, are elongated rods, frequently cylindrical, that are supported at opposite ends by wall mounts. With the passage of time, the building will often settle, which may result in widening or narrowing the separation between the opposing walls. At worst, this may cause damage to the walls or the wall mounts, and even at best, may require adjustments to the curtain rod or curtain rod supports that involve loosening or removing the wall mounts using tools that the homeowner may not have readily available or may not be accustomed to using.

Thus, a curtain rod wall mount solving the aforementioned problems is desired.

SUMMARY

The curtain rod wall mount is a fixture used in pairs to support opposing ends of a cylindrical curtain rod between opposing walls of a building or window frame. In a first embodiment, the wall mount includes a helical spring disposed between a fixed plug and a movable plug, the spring being coaxially disposed around a guide screw extending between the plugs, the spring assembly being housed in a tubular sleeve that an end of the curtain rod slides into to bear against the movable plug. A second embodiment is similar to the first, but omits the guide screw. In a third embodiment, the wall mount has a wall plate having a threaded stud extending therefrom. The tubular sleeve has a plug with an internally threaded bore in one end that engages the threaded stub, the other end being hollow to receive an end of the curtain rod. Adjustments are made by the extent that the stud extends into the threaded bore.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The curtain rod wall mount is a fixture used in pairs to support opposing ends of a cylindrical curtain rod between opposing walls of a building or window frame. In a first embodiment, the wall mount includes a helical spring disposed between a fixed plug and a movable plug, the spring being coaxially disposed around a guide screw extending between the plugs, the spring assembly being housed in a tubular sleeve that an end of the curtain rod slides into to bear against the movable plug. A second embodiment is similar to the first, but omits the guide screw. In a third embodiment, the wall mount has a wall plate having a threaded stud extending therefrom. The tubular sleeve has a plug with an internally threaded bore in one end that engages the threaded stub, the other end being hollow to receive an end of the curtain rod. Adjustments are made by the extent that the stud extends into the threaded bore.

Figure 1:
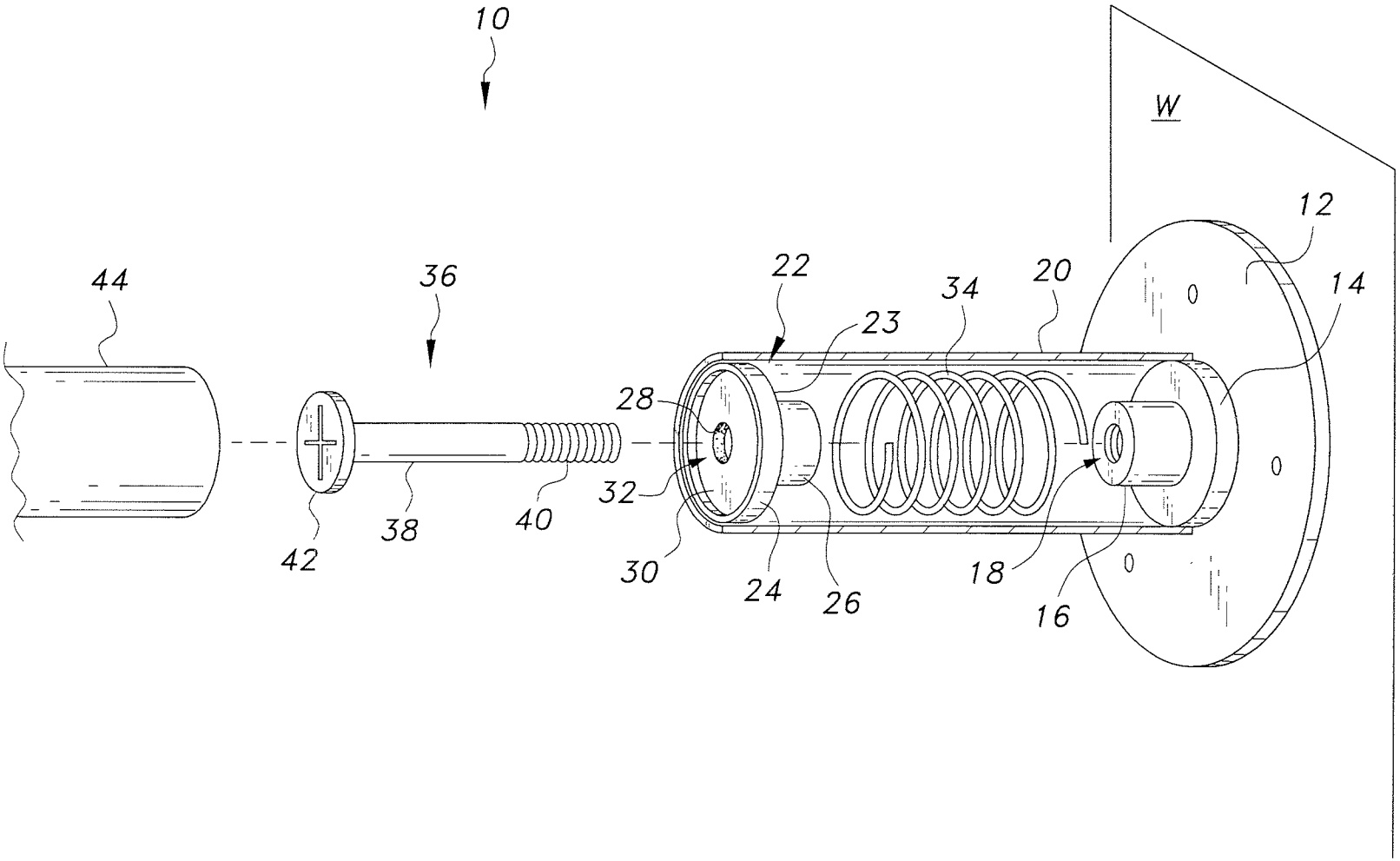
FIG. 1 is partially exploded perspective view of a first embodiment of a curtain rod wall mount, shown with the tubular sleeve in section.

As shown in FIG. 1, in a first embodiment, the curtain rod wall mount 10 includes a wall plate 12, which may be attached to a wall W by Fisher screw wall plugs (otherwise known as anchors or expansion plugs, commonly made of plastic) and a plurality of screws. Although the wall plate 12 is shown as being circular in FIG. 1, the wall plate may be square, oval, or any decorative shape. A circular sleeve alignment guide 14 is concentrically attached to the wall plate 12, and a fixed plug 16 is concentrically attached to the alignment guide 14. The fixed plug 16 has an internally threaded bore 18 defined therein. An elongated, rigid, tubular sleeve 20 has one end disposed over the alignment guide 14. The sleeve 20 may be fixed to the alignment guide 14 by welding, friction fit, or the like, or may be loosely coupled over the alignment guide. The tubular sleeve 20 has a diameter slightly greater than the diameter of the alignment guide 14 so that the alignment guide 14 prevents the sleeve 20 from sliding laterally.

A piston 22 is slidably disposed in the opposite end of the tubular sleeve. The piston 22 has a circular end plate 23 and an annular flange 24 extending orthogonally from the perimeter of the end plate 23 to define a lip bordering a recess. A retainer plug 26 extends from the circular end plate towards the wall plate 12. A resilient gasket 28 of rubber may be glued to the opposite face of the end plate 23 of the piston 22. A bearing plate 30 having a central aperture 32 defined therein is disposed inside the lip formed by the annular flange 24. The central aperture 32 is aligned with a bore extending through the gasket 28, the end plate of the piston 22, and the retainer plug 26. A helical compression spring 34 extends between the end plate 23 of the piston 22 and the sleeve alignment guide 14. The fixed plug 16 and the retainer plug 26 each extend though the first coil or two at opposite ends of the spring 34, the plugs 16 and 26 each having a diameter slightly smaller than the diameter of the coil at opposite ends of the spring 34. A partially threaded guide screw 36 having a smooth shank portion 38 above the threads 40 extends through the central aperture 32 and bore defined in the piston 22, and then coaxially through the spring 34, and threads into the threaded bore 18 defined in the fixed plug 16, the guide screw 36 having a head 42 that bears against the bearing plate 30.

The lip defined by the annular flange 24 has an internal diameter slightly smaller than the diameter of the curtain rod 44. The curtain rod 44 may be installed between two opposing wall mounts 10 by pressing one end of the curtain rod 44 against the bearing plate 30 of one of the wall mounts 10 to compress the spring 34 far enough to insert the opposite end of the curtain rod 44 into the tubular sleeve 20 to bear against the piston 22 of the other wall mount 10. The smooth shank 38 of the guide screw 36 allows the piston 22 to slide within the sleeve 20 as the spring 34 is compressed. Similarly, the springs 34 in the opposing wall mounts 10 automatically adjust tension against opposite ends of the curtain rod 44 to retain the curtain rod 44 as the space between opposing walls of the building expands and contracts during settling.

Exemplary dimensions of the components of the wall mount 10 include the following: the tubular sleeve 20 has a length of 2.50-3.00 cm; and the annular flange 24 defines a recess having a depth up to 0.25 cm.

Figure 2:
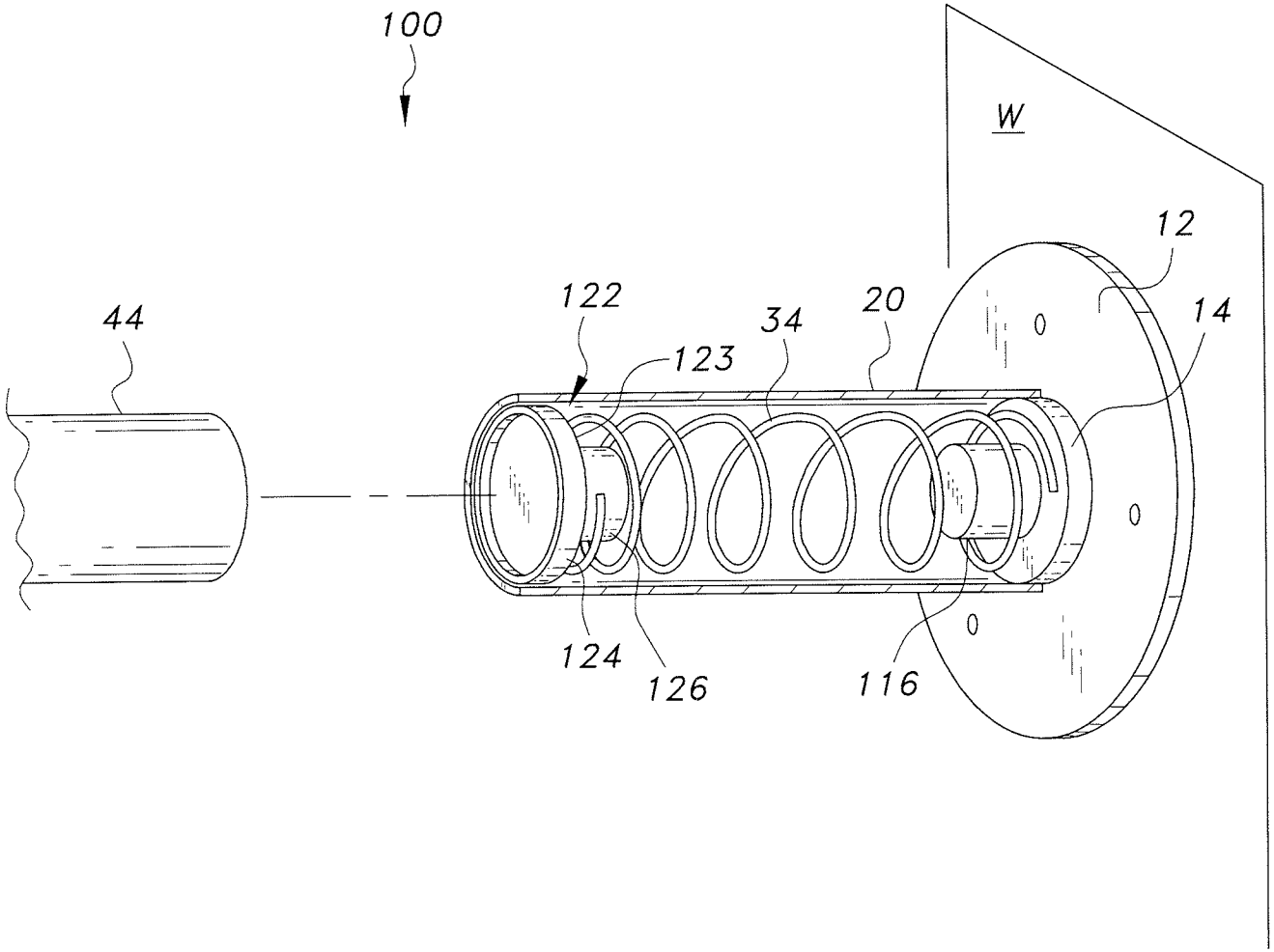
FIG. 2 is a partially exploded perspective view of a second embodiment of a curtain rod wall mount, shown with the tubular sleeve in section.

FIG. 2 shows a second embodiment of a wall mount 100 that is similar to the embodiment of FIG. 1, but omits the guide screw. The wall mount 100 has a wall plate 12 that may be attached to a wall W by Fisher screw wall plugs (otherwise known as anchors or expansion plugs, commonly made of plastic) and a plurality of screws. A circular sleeve alignment guide 14 is concentrically attached to the wall plate 12, and a fixed plug 116 is concentrically attached to the alignment guide 14. The fixed plug 116 is solid and has no bore defined therein. An elongated, rigid, tubular sleeve 20 has one end disposed over the alignment guide 14. The sleeve 20 may be fixed to the alignment guide 14 by welding, friction fit, or the like, or may be loosely held over the alignment guide. The tubular sleeve 20 has a diameter slightly greater than the diameter of the alignment guide 14 so that the alignment guide 14 prevents the sleeve 20 from sliding laterally.

A piston 122 is slidably disposed in the opposite end of the tubular sleeve 20. The piston 122 has a circular end plate 123 and an annular flange 124 extending orthogonally from the perimeter of the end plate 123 to define a lip bordering a recess. A retainer plug 126 extends from the circular end plate 123 towards the wall plate 12. A helical compression spring 34 extends between the end plate 123 of the piston 122 and the sleeve alignment guide 14. The fixed plug 116 and the retainer plug 126 each extend though the first coil or two at opposite ends of the spring 34, the plugs 116 and 126 each having a diameter slightly smaller than the diameter of the coil at opposite ends of the spring 34. In this embodiment, the ends of the spring 34 are fixed to the fixed plug 116 and the retainer plug 126, respectively, by welding, friction fit, fasteners, or the like.

The lip defined by the annular flange 124 has an internal diameter slightly smaller than the diameter of the curtain rod 44. The curtain rod 44 may be installed between two opposing wall mounts 100 by pressing one end of the curtain rod 44 against the piston 122 of one of the wall mounts 100 to compress the spring 34 far enough to insert the opposite end of the curtain rod 44 into the tubular sleeve 20 to bear against the piston 122 of the other wall mount 100. The tubular sleeves 20 prevent the springs 34 from deflecting laterally as the springs 34 are compressed. Similarly, the springs 34 in the opposing wall mounts 100 automatically adjust tension against opposite ends of the curtain rod 44 to retain the curtain rod 44 as the space between opposing walls of the building expands and contracts during settling.

Exemplary dimensions of the components of the wall mount 100 include the following: the tubular sleeve 20 has a length of 2.50-3.00 cm; the annular flange 124 defines a recess having a depth up to 0.25 cm; and the plugs 116 and 126 extend into the coil springs 34 a distance sufficient to assist in maintaining stability of the spring 34, which may be a distance up to 0.50 cm.

Figure 3:
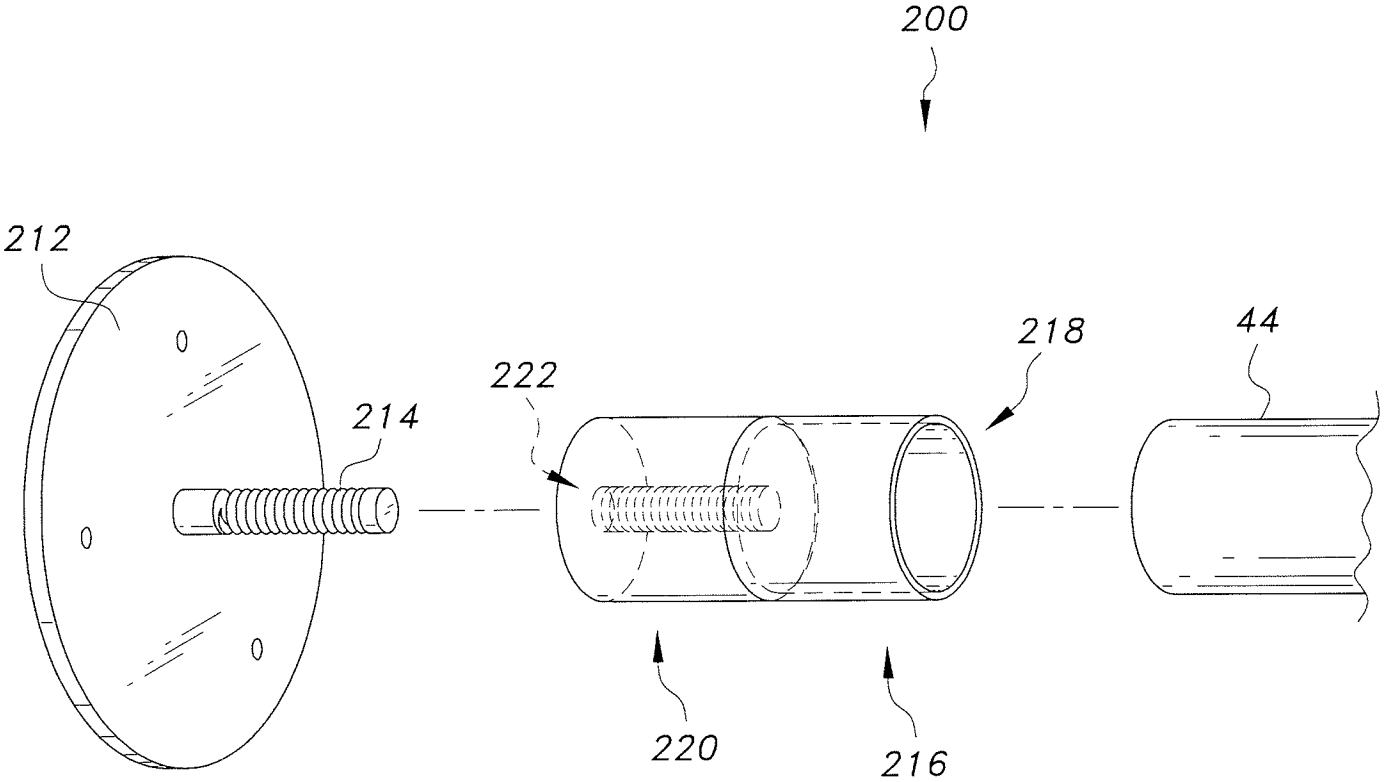
FIG. 3 is a partially exploded perspective view of a third embodiment of a curtain rod wall mount.

FIG. 3 shows a third embodiment of a curtain rod wall mount 200 that does not include a resilient spring. As shown in FIG. 3, the curtain rod wall mount 200 includes a wall plate 212, which may be attached to a wall by Fisher screw wall plugs (otherwise known as anchors or expansion plugs, commonly made of plastic) and a plurality of screws. Although the wall plate 212 is shown as being circular in FIG. 1, the wall plate may be square, oval, or any decorative shape. A threaded stud 214 extends concentrically from the wall plate 212.

The wall mount 200 includes an elongated, rigid, tubular sleeve 216 disposed between the wall plate 212 and the curtain rod 44. The sleeve 216 includes a hollow end 218 dimensioned and configured for receiving one end of the curtain rod 44, the curtain rod 44 being slidable in the hollow end 218. A plug 220, e.g., an elongated cylindrical plug, is fixed in the opposite end of the tubular sleeve 216. The plug 220 has an internally threaded bore 222 defined therein.

In use, the curtain rod 44 is installed by inserting an end of the curtain rod 44 into the hollow end of the tubular sleeve 216 as far as the plug 220. The threaded bore 222 s aligned with the threaded stud 214, and the tubular sleeve 216 is rotated to thread the sleeve 216 onto the stud 214 until the curtain rod is stably supported. The procedure is repeated with a second wall mount 200 mounted on an opposing wall to support the opposite end of the curtain rod 44. If the building settles and the distance between the opposing walls expands or contracts, the tubular sleeve 216 may be rotated in the same direction as during installation if the distance between opposing walls contracts, or may be rotated in the opposite direction from installation if the distance between opposing walls expands to adjust support for the curtain rod 44 by adjusting how far the ends of the curtain rod 44 extend into the hollow ends of the tubular sleeves 216.

Exemplary dimensions of the components of the wall mount 200 include the following: the tubular sleeve 216 has a length of 2.50-3.00 cm; the threaded stud 214 has a length of 1.00-1.25 cm; the hollow end of the tubular sleeve 216 has a length of 1.50-1.75 cm; and the plug 220 has a length between 1.00-1.25 cm.

In each of the various embodiments, the curtain rod wall mounts may be furnished in diameters dimensioned and configured for supporting cylindrical curtain rods of different diameters.

It is to be understood that the curtain rod wall mount is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A curtain rod wall mount, comprising:

a wall plate adapted for mounting on a wall;

a sleeve alignment guide mounted on the wall plate, the alignment guide defining a perimeter, a fixed plug extending from the sleeve alignment guide;

a tubular sleeve having a first end and a second end, the first end fitting closely around the perimeter of the sleeve alignment guide to prevent lateral slipping of the sleeve;

a piston slidably mounted in the second end of the tubular sleeve, the piston having an end plate having an annular flange extending orthogonally from the end plate to define a recess dimensioned and configured for receiving an end of a curtain rod, the flange being adapted for preventing lateral slipping of the curtain rod;

a retainer plug extending from the end plate of the piston towards the wall plate; and a helical compression spring disposed within the tubular sleeve and having a first end bearing against the sleeve alignment guide and a second end bearing against the end plate of the piston, the fixed plug and the retainer plug extending partially into coils at opposite ends of the compression spring to stabilize the spring.

2. The curtain rod wall mount according to claim 1, wherein the first end of said compression spring is rigidly attached to said fixed plug and the second end of said compression spring is rigidly attached to said retainer plug.

3. The curtain rod wall mount according to claim 1, wherein said fixed plug has an internally threaded bore defined therein and the end plate of said piston has a bore defined therein, the wall mount further comprising:

a bearing plate having a central aperture defined therein, the bearing plate being disposed in the recess defined by the annular flange of said piston; and a partially threaded guide screw having a head, a smooth shank portion extending from the head, and a threaded end portion extending from the smooth shank, the smooth shank and threaded end of the guide screw extending through the central aperture in the bearing plate and the bore in the end plate of said piston, the guide screw extending coaxially through said compression spring and secured in the threaded bore of said fixed plug, said piston being slidable over the smooth shank of the guide screw when the curtain rod bears against the bearing plate to compress said compression spring.

4. The curtain rod wall mount according to claim 3, further comprising a resilient gasket disposed between said bearing plate and the end plate of said piston.

5. The curtain rod wall mount according to claim 1, wherein said tubular sleeve is rigid.

6. A curtain rod mounting system, comprising a pair of curtain rod wall mounts according to claim 1 adapted for mounting to opposing walls of a building, each of the wall mounts supporting a respective end of the curtain rod, whereby the wall mounts resiliently adjust tension at the ends of the curtain rod during expansion and contraction of a distance between the opposing walls.

7. A curtain rod wall mount, consisting of:

a wall plate adapted for mounting on a wall;

a threaded stud extending from the wall plate;

a tubular sleeve consisting of:

i) a first and a second end, the first end being hollow and dimensioned and configured for receiving an end of a curtain rod therein; and ii) a plug fixed in the second end of the tubular sleeve, the plug having an internally threaded bore fixed in the second end, the plug being threadable on the threaded stud;

whereby support for the curtain rod is selectively adjustable by threading and unthreading the second end of the tubular sleeve to adjust how far the end of the curtain rod extends into the hollow first end of the tubular sleeve.

8. The curtain rod wall mount according to claim 7, wherein said tubular sleeve is rigid.

9. A curtain rod mounting system, comprising a pair of curtain rod wall mounts according to claim 7 adapted for mounting to opposing walls of a building, each of the wall mounts supporting a respective end of the curtain rod;

whereby support for the curtain rod is selectively adjustable by threading and unthreading the second end of the tubular sleeve on each of the wall mounts in order to adjust how far the respective ends of the curtain rod extend into the hollow first end of the respective tubular sleeves.

* * * * *